US007236148B2

(12) United States Patent
Yoshida et al.

(10) Patent No.: US 7,236,148 B2
(45) Date of Patent: Jun. 26, 2007

(54) DRIVE METHOD OF LIGHT-EMITTING DISPLAY PANEL AND ORGANIC EL DISPLAY DEVICE

(75) Inventors: Takayoshi Yoshida, Yonezawa (JP); Shinobu Adachi, Yonezawa (JP)

(73) Assignee: Tohoku Pioneer Corporation, Tendo-shi (JP)

( * ) Notice: Subject to any disclaimer, the term of this patent is extended or adjusted under 35 U.S.C. 154(b) by 341 days.

(21) Appl. No.: 10/255,179

(22) Filed: Sep. 26, 2002

(65) Prior Publication Data

US 2003/0137475 A1 Jul. 24, 2003

(30) Foreign Application Priority Data

Jan. 18, 2002 (JP) ..... 2002-009808

(51) Int. Cl.
*G09G 3/30* (2006.01)

(52) U.S. Cl. ..... 345/76; 345/77; 345/78; 345/82; 345/83; 345/211; 345/212; 345/213

(58) Field of Classification Search ..... 345/76–78, 345/55, 82–83, 211–213, 214
See application file for complete search history.

(56) References Cited

U.S. PATENT DOCUMENTS

| | | | | |
|---|---|---|---|---|
| 3,708,717 | A * | 1/1973 | Fleming | 345/76 |
| 4,633,380 | A * | 12/1986 | Kashiwazaki | 363/54 |
| 4,707,692 | A * | 11/1987 | Higgins et al. | 345/204 |
| 5,457,488 | A * | 10/1995 | Nakamura et al. | 347/237 |
| 5,594,463 | A * | 1/1997 | Sakamoto | 345/76 |
| 6,590,343 | B2 * | 7/2003 | Pederson | 315/76 |
| 6,747,617 | B1 * | 6/2004 | Kawashima | 345/76 |

FOREIGN PATENT DOCUMENTS

| | | | |
|---|---|---|---|
| JP | 07-036409 | | 2/1995 |
| JP | 2001-195026 | * | 7/2001 |
| JP | 2001-223074 | | 8/2001 |

OTHER PUBLICATIONS

Patent Abstract of Japan, Publication No. 09-232074, dated Sep. 5, 1997.
Office Action from the Chinese Patent Office in the corresponding Chinese patent application dated Oct. 28, 2005.
Office Action from the Chinese Patent Office in the corresponding Chinese patent application dated Jun. 9, 2006.
Office Action from the Japanese Patent Office in the corresponding Japanese patent application dated Mar. 1, 2005.

* cited by examiner

*Primary Examiner*—Richard Hjerpe
*Assistant Examiner*—Leonid Shapiro
(74) *Attorney, Agent, or Firm*—Westerman, Hattori, Daniels & Adrian, LLP.

(57) ABSTRACT

Light-emitting elements disposed on a light-emitting display panel are driven by constant currents, and the forward direction voltages of the light-emitting elements are obtained by a sampling/holding circuit. Then, the voltage output from a drive voltage source composed of a DC-DC converter is controlled by the forward direction voltages obtained by the sampling/holding circuit. For example, in a case in which the light emission luminance of the light-emitting display panel is changed or in other case, a sampling and holding operation is executed by the sampling/holding circuit in response to a control signal from a sampling timing control circuit at intervals shorter than ordinary intervals. With this arrangement, when light emission luminance of a light-emitting display panel is changed, the gentle changing characteristics of the light emission luminance thereof can be improved.

23 Claims, 6 Drawing Sheets

【Fig.1】
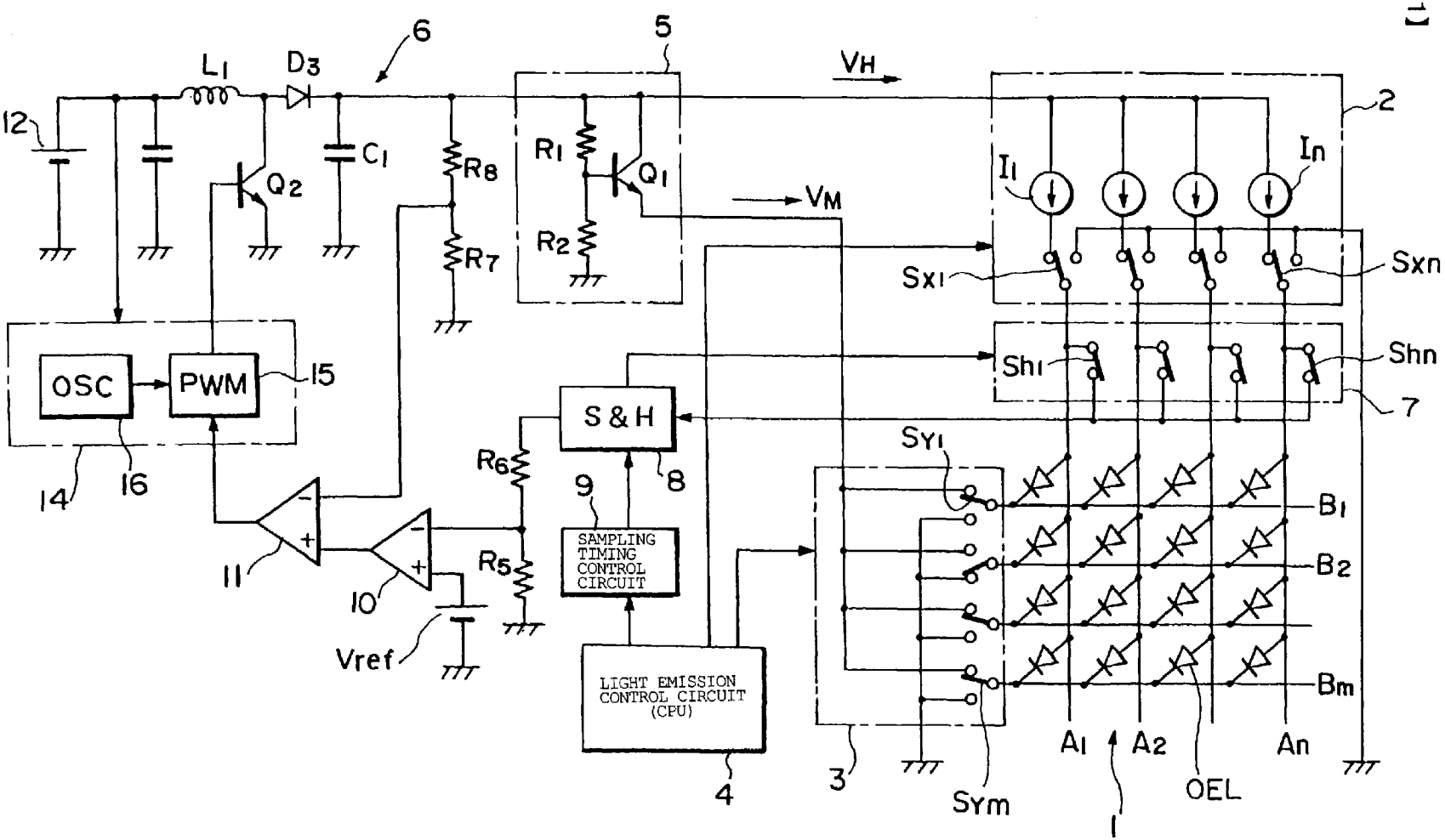

【Fig.2】
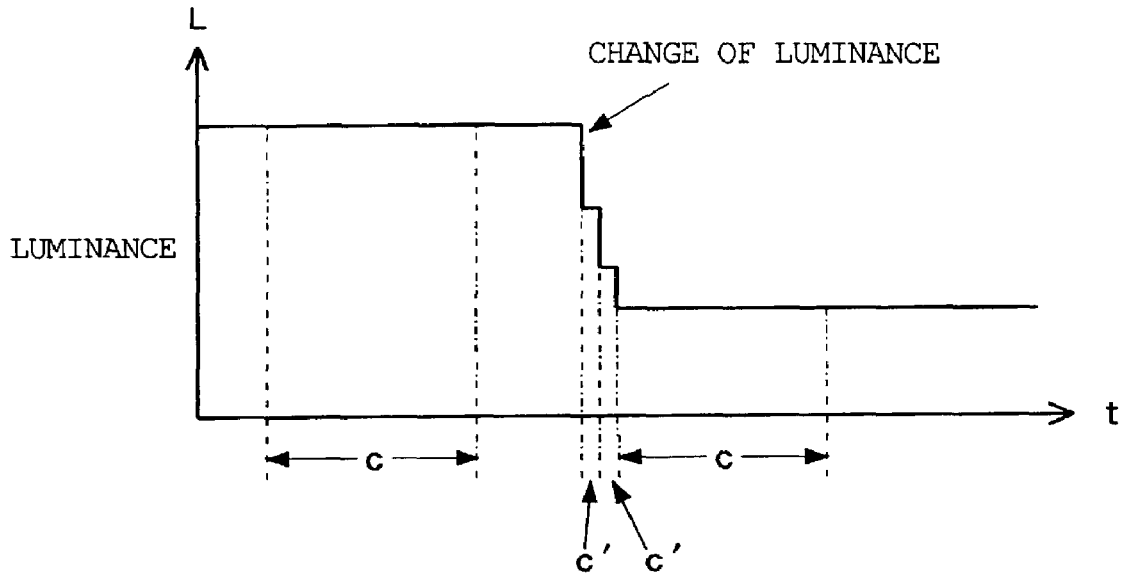
【Fig.3】
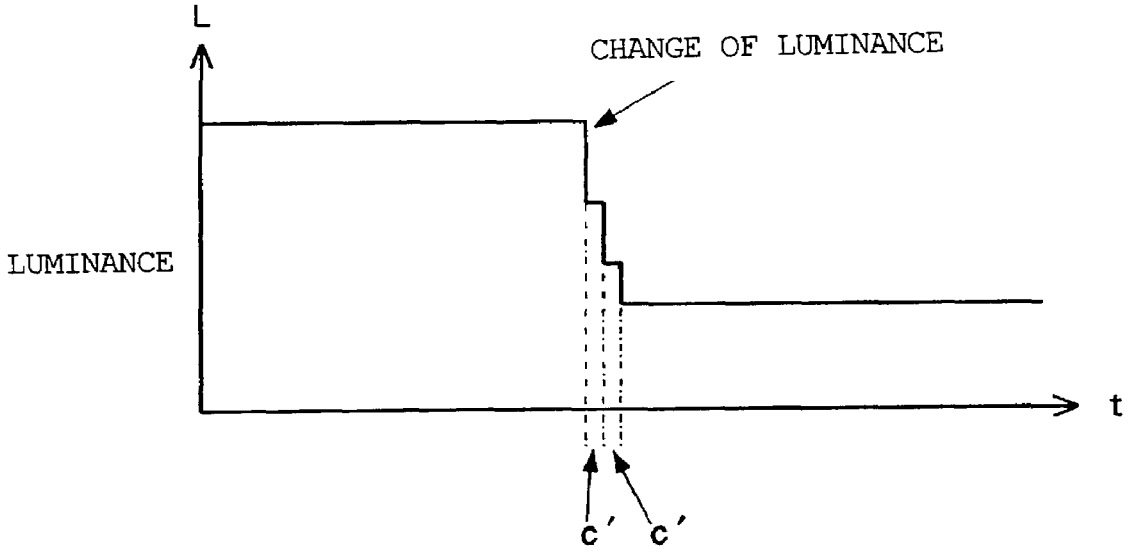

【Fig.4】
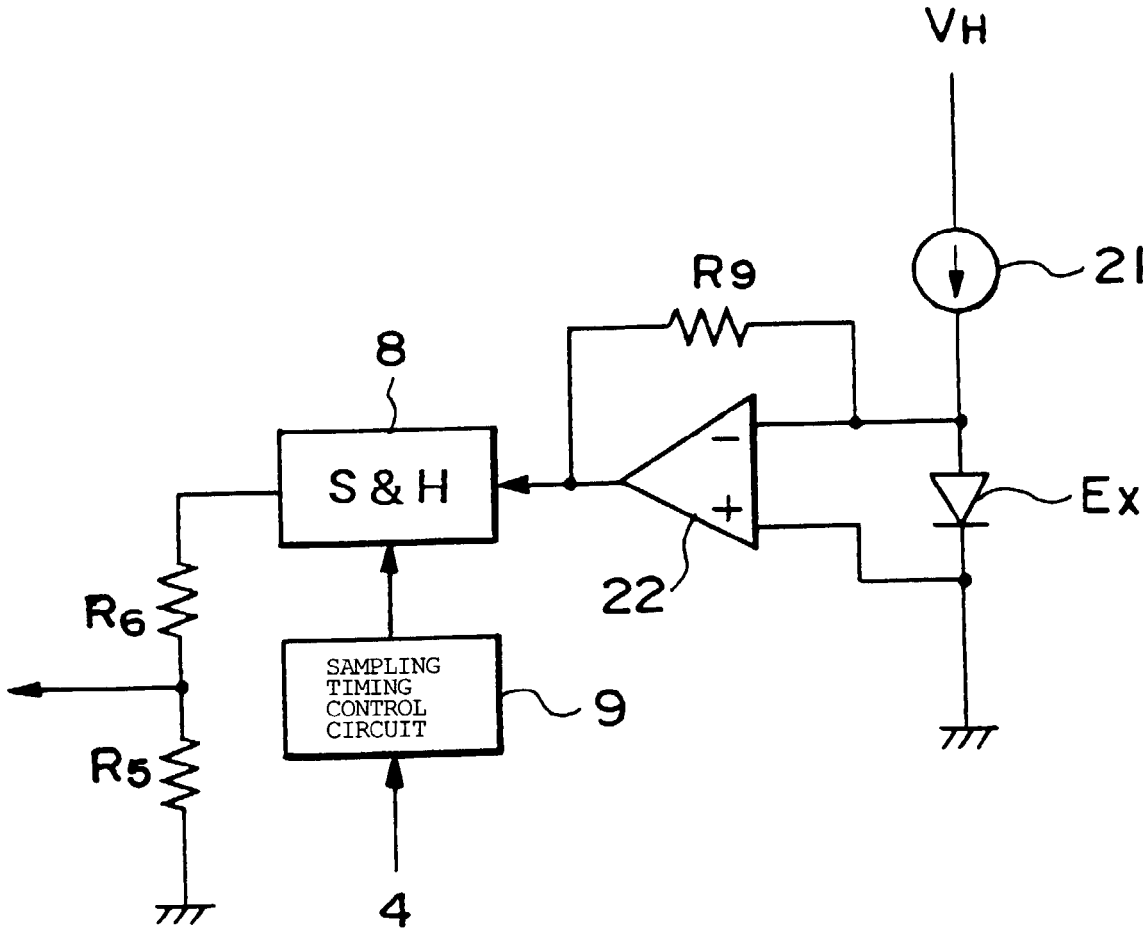

【Fig.5】
PRIOR ART
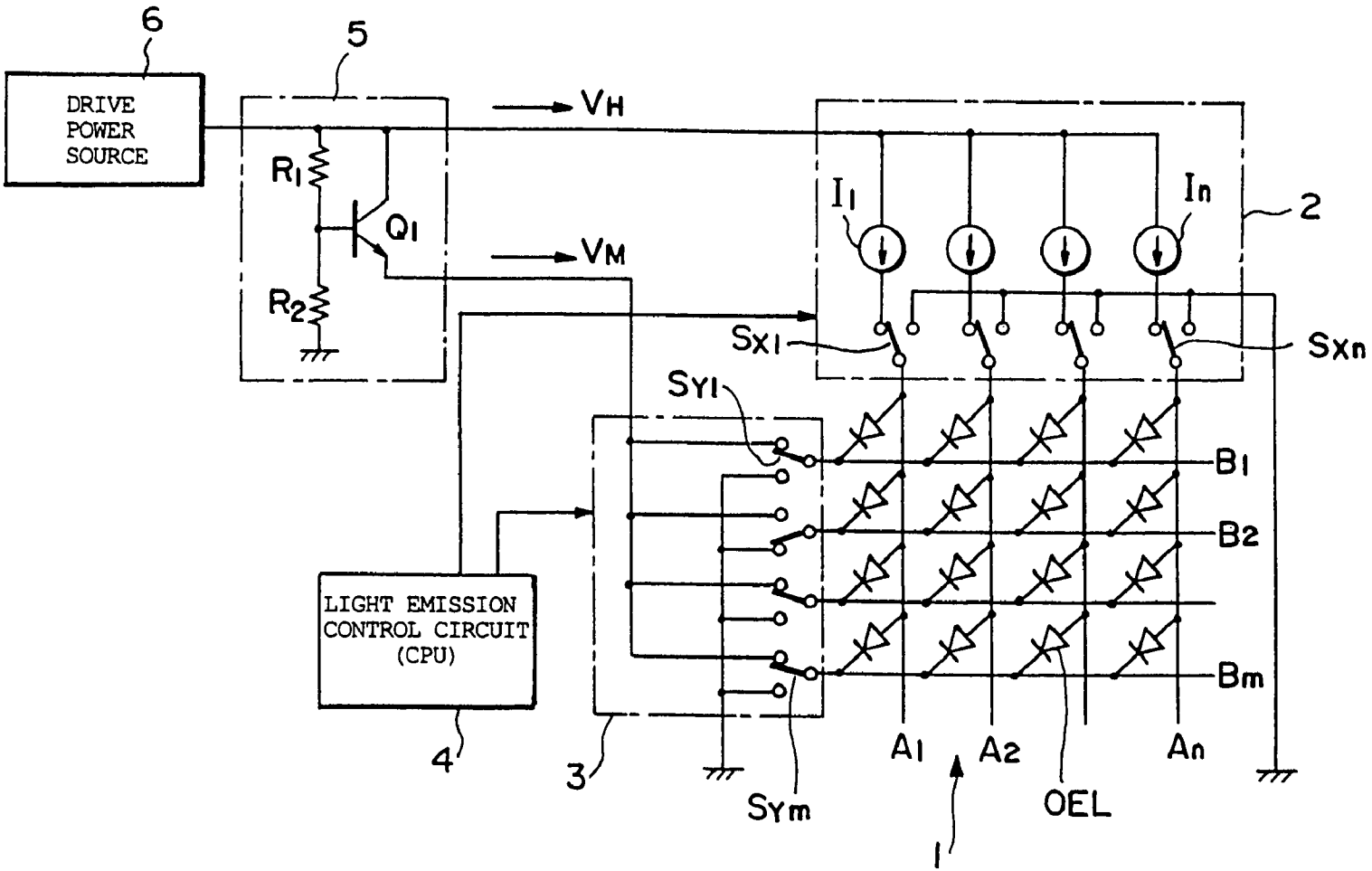

【Fig.6】
PRIOR ART
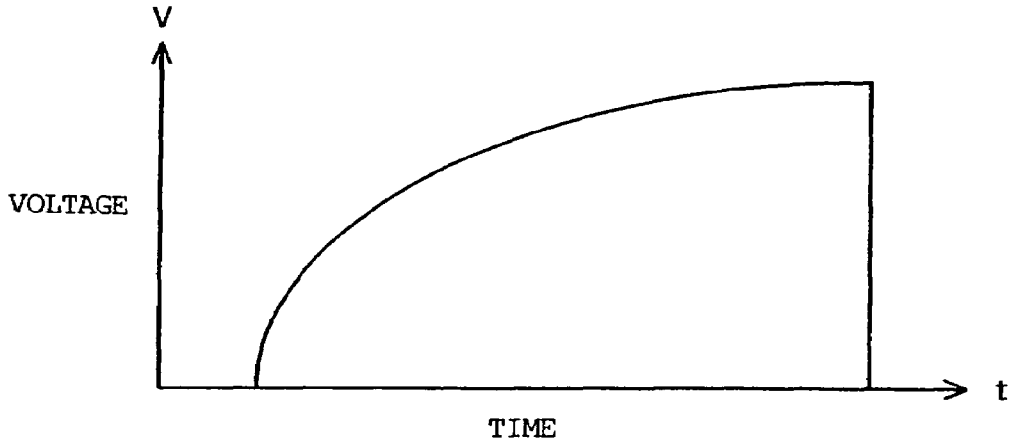
【Fig.7】
PRIOR ART
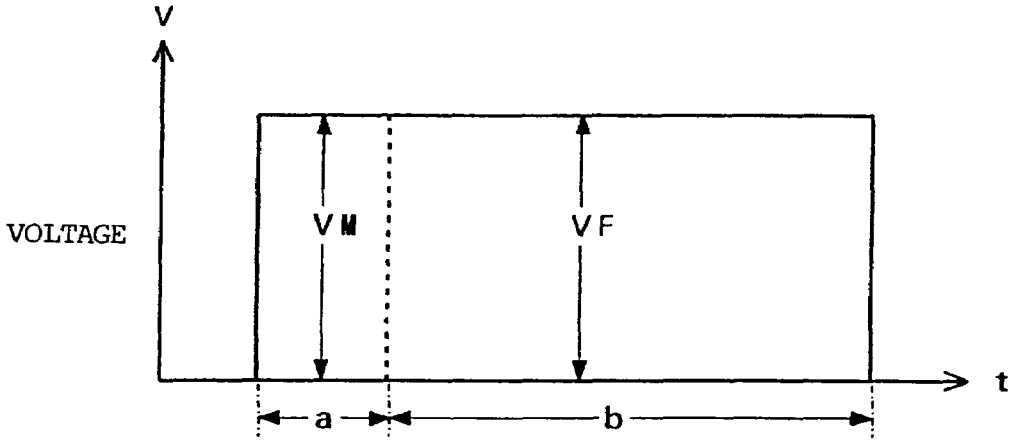
【Fig.8】
PRIOR ART
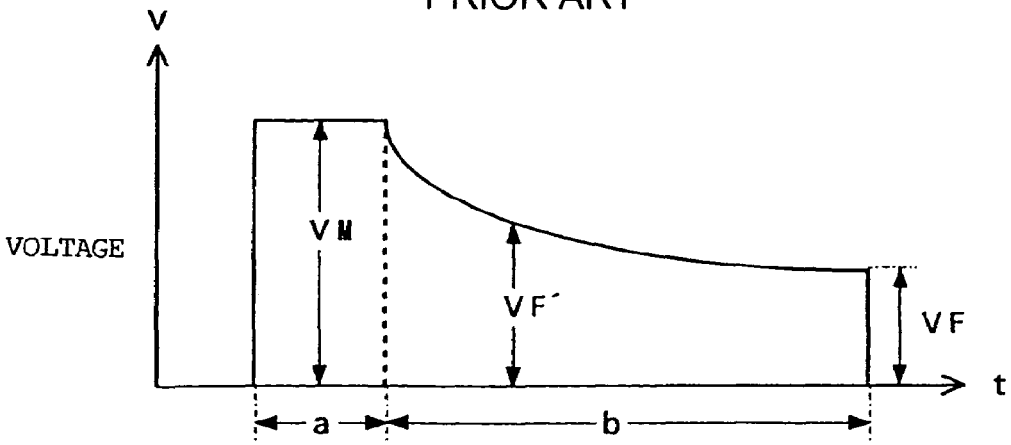

【Fig.9】
PRIOR ART
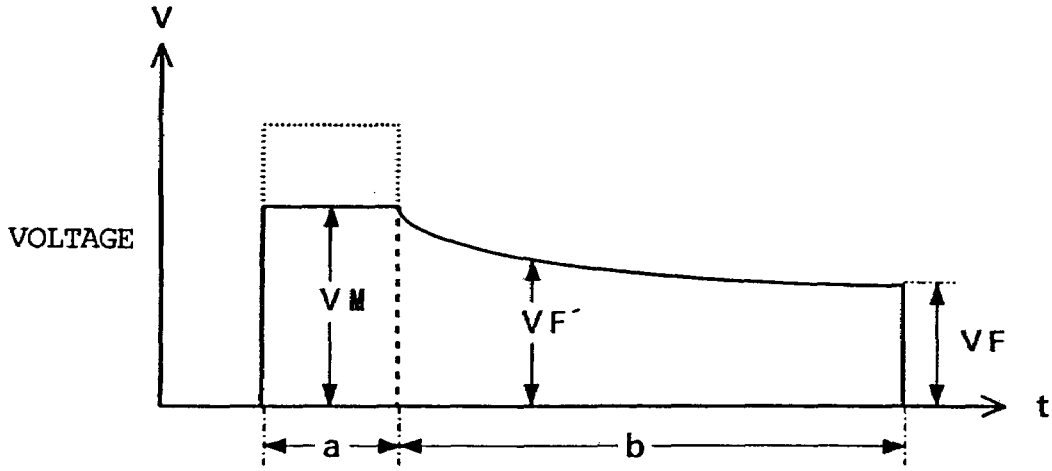
【Fig.10】
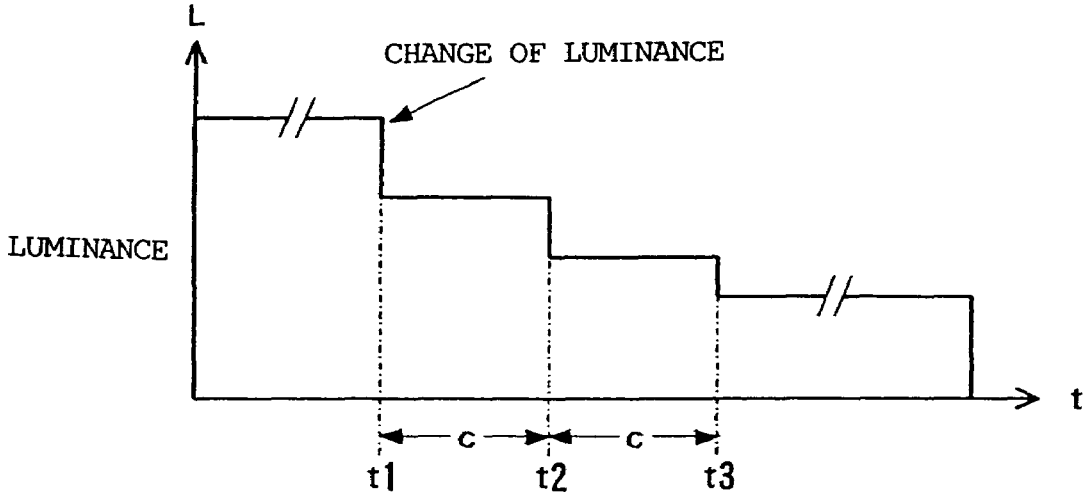
PRIOR ART

DRIVE METHOD OF LIGHT-EMITTING DISPLAY PANEL AND ORGANIC EL DISPLAY DEVICE

BACKGROUND OF THE INVENTION

1. Field of the Invention

The present invention relates to a drive method of a light-emitting display panel using, for example, organic electroluminescence (EL) elements as light-emitting elements and to a display device using the light-emitting display panel, and more particularly, to a control technology for controlling the light-emitting luminance of the light-emitting elements.

2. Description of the Related Art

Attention is paid to an organic EL display as a display replacing a liquid crystal display because the organic EL display can reduce power consumption, can display an image of high quality and further can be reduced in thickness. This is because the efficiency and life of the organic EL display has been improved to a practically usable level by using an organic compound promising good light emitting characteristics for the light-emitting layers of EL elements used in the EL display.

There have been proposed a passive matrix drive system and an active matrix drive system as a drive method of a display panel in which the EL elements are disposed. FIG. 5 shows the passive matrix drive system and an example of the display panel whose light emission is controlled by the passive matrix drive system. Two drive methods, that is, a cathode line scan/anode line drive method and an anode line scan/cathode line drive method are available as a drive method of the organic EL elements in the passive matrix drive system, and the arrangement shown FIG. 5 is an example of the former cathode line scan/anode line drive method.

That is, a display panel 1 is arranged such that anode lines A1 to An are longitudinally disposed as n-pieces of drive lines, whereas cathode lines B1 to Bm are laterally disposed as m-pieces of scan lines, and organic EL elements OEL shown by the symbol of diode are disposed at the intersections (n×m positions in total) of the respective lines. Then, the respective EL elements acting as light-emitting elements constituting pixels are disposed in a lattice shape, and one ends thereof (anode terminals of the EL elements) are connected to the anode lines and the other ends thereof (cathode terminals of the EL elements) are connected to the cathode lines in correspondence to the positions of the intersections between the anode lines A1 to An traveling along a vertical direction and the cathode lines B1 to Bm traveling along a horizontal direction. Further, the anode lines are connected to an anode line drive circuit 2, and the cathode lines are connected a scan circuit 3, so that they are driven respectively.

The cathode line scan circuit 3 has scan switches SY1 to SYm in correspondence to the respective cathode scan lines B1 to Bm that act to connect any one of a reverse bias voltage VM from a reverse bias voltage creation circuit 5 for preventing the crosstalk light emission of the elements and a ground potential acting as a reference potential to a corresponding cathode scan line. Further, the anode line drive circuit 2 has constant current circuits I1 to In for supplying drive currents to the respective EL elements through the respective anode lines and drive switches SX1 to SXn.

The drive switches SX1 to SXn act to connect any one of the currents from the constant current circuits I1 to In and the ground potential to corresponding anode lines. Accordingly, when the drive switches SX1 to SXn are connected to the constant current circuit I1 to In, they act to supply the currents from the constant current circuits I1 to In to the respective EL elements disposed in correspondence to the cathode scan lines.

Note that it is possible to use a voltage source such as constant voltage circuits, and the like in place of the constant current circuit. However, the constant current circuits are ordinarily used as shown in the figure because of the reasons that the voltage/luminance characteristics of the EL elements are unstable to a temperature change while the current/luminance characteristics thereof are stable to the temperature change, that there is a possibility that the EL elements are deteriorated by an excessive current, and the like.

A control bus is connected to the anode line drive circuit 2 and the cathode line scan circuit 3 through a light emission control circuit 4 including a CPU, and the scan switches SY1 to SYm and the drive switches SX1 to SXn are manipulated based on the signals of an image to be displayed. With this arrangement, the constant current circuits I1 to In are appropriately connected to desired anode lines while setting the cathode scan lines to the ground potential at a predetermined cycle based on the image signals. Accordingly, the respective light-emitting elements selectively emit light, thereby the image is reproduced on the display panel 1 based on the image signals.

A DC output (output voltage=VH) from a drive voltage source 6 composed of, for example, a voltage increasing type DC-DC converter is supplied to the respective constant current circuits I1 to In of the anode line drive circuit 2. With this arrangement, the constant currents created by the constant current circuits I1 to In having received the output voltage VH from the drive voltage source 6 are supplied to the respective EL elements disposed in correspondence to the anode scan lines.

In contrast, the value of the reverse bias voltage VM used to prevent the crosstalk light emission of the EL elements is ordinarily generated by being series regulated from the output voltage VH because the voltage VM is relatively near to the value of the output voltage VH and the current consumed by the reverse bias voltage VM is smaller than that of the output voltage VH. It is considered that the employment of the above arrangement is advantageous from the view point of the number of parts and power consumption.

A reverse bias voltage creation circuit 5 arranged simply as shown in FIG. 5 can be preferably employed as the series regulating circuit. The reverse bias voltage creation circuit 5 is composed of a voltage division circuit for dividing the output voltage VH from the drive voltage source 6 and a transistor Q1 for outputting a divided voltage created by the voltage division circuit as a reverse bias voltage after it has been subjected to impedance transformation. That is, the voltage division circuit is composed of resistors R1 and R2 connected in series between the drive voltage source 6 and the reference potential (ground), and the collector terminal of the npn transistor Q1 that achieves the impedance transformation function is connected to the drive voltage source 6, and the base thereof is connected to the node between the resistors R1 and R2. With this arrangement, the transistor Q1 is in an emitter follower connection, and the reverse bias voltage VM is output from the emitter terminal of the transistor Q1.

Incidentally, according to a drive unit arranged as described above, the constant current circuits are provided in correspondence to the respective anode lines to drive the respective EL elements by the constant currents. In the constant current circuits, a certain amount of voltage drop in the circuits must be taken into consideration to drive the respective EL elements by the constant voltage at all times. Accordingly, the output voltage VH from the drive voltage source 6, which is supplied to the constant current circuits, must have a value equal to or larger than the value obtained by adding the amount of voltage drop arisen in the constant current circuits to the forward direction voltages VF of the respective EL elements driven by the constant currents.

Moreover, when the electric dispersion and deterioration with age of the respective EL elements and further the dispersion of the respective elements in the constant current circuits are taken into consideration, it is necessary to set the output voltage VH by adding a predetermined margin to the forward direction voltages VF, in addition to the amount of voltage drop in the constant current circuits. When this margin is added, the amount of voltage drop is made excessive in almost all the constant current circuits, thereby a problem is arisen in that a power loss is increased in the constant current circuits.

Thus, it is contemplated to detect the forward direction voltages VF of the respective EL elements driven by the constant voltage by, for example, a sampling/holding means and to control the value of the output voltage VH supplied from the drive voltage source 6 based on the thus sampled forward direction voltages VF. When the control means described above is employed, it is possible to create the output voltage VH by adding a given voltage value capable of guaranteeing the constant current drive of the respective EL elements in the constant current circuits to the forward direction voltage VF. Accordingly, it is possible to set the margin to a very small amount so as to reduce the power loss in the constant current circuits. With this arrangement, when this drive method is used in, for example, mobile appliances, and the like, the power consumption of batteries can be reduced.

In contrast, it is known that the organic EL elements described above have diode characteristics including a predetermined electric capacitance (parasitic capacitance) from the laminated structure thereof. Then, when the organic EL elements are driven by constant currents, as described above, the waveform of the anode voltage of the elements has such a characteristic that it gently rises up as shown in FIG. 6 because the constant current circuits are high impedance output circuits in the operation principle thereof. That is, in FIG. 6, a vertical axis shows the anode voltage V of the element, and a lateral axis shows an elapsed time t.

The rising-up curve of the anode voltage V is changed by various conditions such as the lighting/non-lighting condition of the elements when they were scanned last time, the lighting/non-lighting condition of adjacent elements, and the like. Then, the luminance of the organic EL elements is changed by the change of the rising-up curve. However, the substantial luminance of the display panel cannot help being dropped because the rising-up of the light emission of the element is delayed.

To cope with this problem, there has been proposed a drive method of connecting a constant voltage source to elements when the elements are lit/driven and providing an instantly charging precharge period with the parasitic capacitances of the elements. There is available a cathode reset method as a typical drive method of executing the precharge and is disclosed in, for example, JP-A No. 9-232074. According to the cathode reset method, it is possible to instantly rise the anode voltage of an EL element to be lit to a voltage near to the reverse bias voltage VM by making use of the reverse bias voltage VM for preventing the parasitic capacitances of elements and the crosstalk light emission.

FIG. 7 shows an anode voltage waveform when a precharge voltage (VM) is set equal to the forward direction voltage (VF) of an element. A vertical axis shows the anode voltage V of the element, and a lateral axis shows an elapsed time t also in FIG. 7. Then, a period a shows a precharge period with respect to the element, and a period b shows the constant current drive period of the element.

In contrast, the following problem is arisen when the precharge drive described above is executed as well as when the forward direction voltages VF of the EL elements are obtained by making use of, for example, the sampling/holding means and the control means described above is employed to control the value of the output voltage VH supplied from the drive voltage source 6. That is, when the light emission luminance of light-emitting elements is dropped while they are, for example, being lit, the forward direction voltages VF of the elements are dropped from the state shown in FIG. 7 to the state shown in FIG. 8. At this time, a final forward direction voltage VF cannot be sampled and held at the timing of a sampling operation but a voltage denoted by VF' is held based on the timing of the sampling operation, and the output voltage VH of the drive voltage source 6 is controlled based on the thus held voltage VF'.

Since the voltage VM used for the precharge is created based on the output voltage VH from the drive voltage source 6, next, a precharge voltage VM lower than that shown in FIG. 9 is created based on the held voltage VF' shown in FIG. 8. Accordingly, the luminance of the light-emitting elements does not drop instantly but drops stepwise as shown in FIG. 10. Thus, a problem is arisen in that the gentle change of luminance as described above is felt unnatural by a user. Note that t1, t2, and t3 in FIG. 10 show timing at which sampling operations are executed, and c shows sampling intervals.

Thus, the above problem is also arisen similarly when the luminance is risen. Further, it is also arisen when the light-emitting elements are driven by the constant currents without executing the above precharge. Furthermore, the above problem is not limited to the case in which the light emission luminance is changed while the display panel is being lit but a similar problem is also arisen when, for example, the display panel starts to be lit.

The above phenomenon is caused by the timing of the sampling hold. Accordingly, it is conceived to execute the sampling hold at timing of short intervals. However, when the sampling hold is executed at the timing of the short intervals, a drive power necessary to the sampling hold operation and a held voltage are discharged each time the sampling hold operation is executed, thereby a power is wasted. Therefore, when for example, the drive method is used in mobile terminals, and the like, the power of batteries are wasted, and thus this drive method is not preferable.

SUMMARY OF THE INVENTION

An object of the present invention, which was made in view of the above technical views of point, is to provide a drive method of a light-emitting display panel capable of reducing the drive electric power as well as capable of improving the gentle operation characteristics of light emission luminance generated when, for example, the light emission luminance of the display panel is changed or when the display panel starts to be lit, as described above, and to provide an organic EL display device using the drive method.

A drive method of a light-emitting display panel according to the present invention, which was made to achieve the above object, is a drive method of a light-emitting display panel including light-emitting elements whose lighting is controlled through constant current circuits, wherein the drive method includes the steps of supplying constant currents to the light-emitting elements from the constant current circuits making use of the voltage output from a drive voltage source, controlling the voltage output from the drive voltage source based on the forward direction voltages of the light-emitting elements, and adjusting the timing at which the voltage output from the drive voltage source is controlled based on the lighting drive condition of the light-emitting elements.

Then, in a first control aspect according to the present invention, when the light-emitting display panel starts to be lit, it is preferable that the voltage output from the drive voltage source based on the forward direction voltages be controlled at timing of shorter intervals. Further, it is preferable that the voltage output from the drive voltage source based on the forward direction voltages be controlled also at timing of shorter intervals when the light emission luminance of the light-emitting display panel is changed. In this case, when the light emission luminance of the light-emitting display panel is changed beyond a predetermined range set beforehand, the voltage output from the drive voltage source based on the forward direction voltages may be controlled at timing of shorter intervals.

In contrast, in a second control aspect according to the present invention, the voltage output from the drive voltage source based on the forward direction voltages may be controlled when the light-emitting display panel starts to be lit. Further, it is preferable that the voltage output from the drive voltage source based on the forward direction voltages be controlled also when the light emission luminance of the light-emitting display panel is changed.

In addition to the above, in the second control aspect, it is preferable that the voltage output from the drive voltage source based on the forward direction voltages be repeatedly controlled a plurality of times when the light-emitting display panel starts to be lit or when the light emission luminance of the light-emitting display panel is changed.

Then, when any of the first and second control modes is employed, the forward direction voltages may be sampled at the timing at which constant currents are supplied from the constant current circuits to the light-emitting elements, and the forward direction voltages may be obtained by a sampling/holding circuit for holding the sampled voltage values in a preferable embodiment. Further, the forward direction voltages may be obtained by adding a constant current to a dummy light-emitting element that does not contribute to the light emission of the light-emitting display panel.

In addition to the above, it is preferable that a voltage drop in the constant current circuits be controlled substantially constant by controlling the voltage output from the drive voltage source, and a voltage increasing type DC-DC converter is preferably used as the drive voltage source.

In a display device according to the present invention, organic EL elements are utilized as the light-emitting elements and driven and lit by employing the drive method described above.

According to the display device employing the drive method, the forward direction voltages of the light-emitting elements supplied through the constant current circuits are detected so as to control the voltage output from the drive voltage source, thereby the constant current circuits for supplying constant currents to the respective EL elements can minimize the voltage drop thereof within a range in which a constant current supply operation can be secured. Accordingly, this arrangement can contribute to the reduction of an electric power loss in the constant current circuits.

When the first control aspect is employed, the voltage output from the drive voltage source is controlled at timing of shorter intervals than ordinary intervals when, for example, the light-emitting display panel starts to be lit or when the light emission luminance of the light-emitting display panel is changed, thereby the gentle changing characteristics of the light emission luminance of the display panel can be improved. Then, when the first control aspect is employed, the intervals at which the forward direction voltages of the elements are sampled and held are shortened for only a predetermined period, thereby the degree of an electric power loss caused by the sampling and holding operation can be reduced.

Further, when the second control aspect is employed, the voltage output from the drive voltage source based on the forward direction voltages of the elements is controlled only when, for example, the light-emitting display panel starts to be lit or when the light emission luminance of the light-emitting display panel is changed. In this case, the gentle changing characteristics of the light emission luminance can be improved by repeatedly controlling the voltage output from the drive voltage source a plurality of times. In this case, since the operation for sampling and holding the forward direction voltages of the elements is executed for only a predetermined period, the degree of an electric power loss caused by the sampling and holding operation can be more reduced.

Note that when the second control aspect is employed, the voltage output from the drive voltage source is controlled only when the light-emitting display panel starts to be lit or when the light emission luminance of the light-emitting display panel is changed. However, the electric deterioration with age and temperature dependency of the light-emitting elements can be compensated at the time. Accordingly, sufficient compensation characteristics can be secured in practical use.

BRIEF DESCRIPTION OF THE DRAWINGS

FIG. 1 is a wiring diagram showing an embodiment of a display device employing a drive method according to the present invention;

FIG. 2 is a timing chart showing light emission luminance characteristics changed by the display device showed in FIG. 1;

FIG. 3 is a timing chart showing light emission luminance characteristics changed by other control aspect;

FIG. 4 is a wiring diagram showing an example using a dummy organic EL element to obtain a forward direction voltage of a light-emitting element;

FIG. 5 is a wiring diagram showing an example of a conventional light emission drive unit;

FIG. 6 is a characteristic view showing a rising-up state of an anode voltage in a light-emitting element driven by a constant current;

FIG. 7 is a characteristic view showing an anode voltage when precharge is executed to a light-emitting element.

FIG. 8 is a characteristic view showing a change of a forward direction voltage when the light emission luminance of a light-emitting elements is dropped when it is being lit;

FIG. 9 is a characteristic view showing a further change of the forward direction voltage of the light-emitting element subsequent to that shown in FIG. 8; and FIG. 10 is a characteristic view showing an example of a change of luminance when the luminance of a light-emitting elements is dropped.

DESCRIPTION OF THE PREFERRED EMBODIMENTS

A drive unit of a light-emitting display panel according to the present invention will be explained as to a preferable embodiment thereof with reference to the figures. FIG. 1 shows a passive matrix drive system to which the present invention is applied and an example of a display panel whose light emission is controlled by the passive matrix drive system. Note that, in FIG. 1, a display panel 1, an anode line drive circuit 2, a cathode line scan circuit 3, and a light emission control circuit 4 that drive the display panel 1, and further a reverse bias voltage creation circuit 5 have the same functions as those of the respective circuits shown in FIG. 5 described above, and thus the detailed description thereof is appropriately omitted.

In the embodiment shown in FIG. 1, a sampling switch 7 is interposed between the anode line drive circuit 2 and the display panel 1. The sampling switch 7 includes switches denoted by Sh1 to Shn in correspondence to drive switches Sx1 to Sxn in the anode line drive circuit 2 and anode lines A1 to An in the display panel 1. These switches Sh1 to Shn are opened and closed in response to a control signal from a sampling/holding circuit 8.

That is, the light emission control circuit 4 drives the sampling/holding circuit 8 through a sampling timing control circuit 9 which will be described later in synchronism with that the light emission control circuit 4 lights and controls respective EL elements through the respective drive switches SX1 to SXn to thereby close the respective switches Sh1 to Shn. Then, the forward direction voltages VF of the respective EL elements are supplied to the sampling/holding circuit 8 through the respective switches Sh1 to Shn, thereby the forward direction voltages VF of the respective EL elements can be obtained.

In FIG. 1, while sampling values from the respective switches Sh1 to Shn are supplied to the sampling/holding circuit 8 through a single connection line for the convenience of illustration, actually, discrete forward direction voltages are supplied to the sampling/holding circuit 8, respectively. Note that the operation of the sampling/holding circuit 8 controlled by the above sampling timing control circuit 9 will be described later.

A forward direction voltage held by the sampling/holding circuit 8 is supplied to one input terminal (inverted input terminal) of an error amplifier 10 through a voltage division circuit composed of resistors R5 and R6. In contrast, a reference voltage Vref is supplied to the other input terminal (non-inverted input terminal) of the error amplifier 10, and thus a comparison output (error output) between the forward direction voltage and the reference voltage is created by the error amplifier 10.

Then, the output from the error amplifier 10 is supplied to one input terminal (non-inverted input terminal) of a differential amplifier 11. Further, the output from resistors R7 and R8 that divide the output voltage VH of a drive voltage source 6 is supplied to the other input terminal (inverted input terminal) of the differential amplifier 11. Therefore, the values of the output voltages of the differential amplifier 11 include both the output information of the forward direction voltages VF of the light-emitting elements and the output information of the output voltage VH of the drive voltage source 6.

In the embodiment shown in FIG. 1, a voltage increasing type DC-DC converter is used as the drive voltage source 6, and the output from the differential amplifier 11 is supplied to a switching regulator circuit 14 constituting the DC-DC converter. Note that while the drive voltage source 6 composed of the DC-DC converter that will be described below creates a direct current output by pulse width modulation (PWM) control, it may utilize pulse frequency modulation (PFM) control.

The switching regulator circuit 14 includes a PWM circuit 15 and a reference oscillator 16 disposed therein. The output from the differential amplifier 11 is supplied to the PWM circuit 15 and modulates the pulse width of the signal supplied from the reference oscillator 16 so that an npn transistor Q2 is switched in response to the modulated pulse output. That is, the electric power energy from a DC voltage source 12 is accumulated in an inductor L1 by the turning-on operation of the npn transistor Q2. In contrast, the electric power energy accumulated in the inductor L1 is accumulated in a capacitor C1 through a diode D3 by the turning-off operation of the npn transistor Q2.

Then, an increased DC output voltage can be obtained as the terminal voltage of the capacitor C1 by repeating the turning-on/off operation of the transistor Q2, and the DC output acts as the output voltage VH output from the drive voltage source 6. Accordingly, in this embodiment, the output voltage VH depends on the forward direction voltages VF when the EL elements are lit.

Further, in this embodiment, the output voltage VH is controlled also by the output voltage divided by the resistors R7 and R8. Thus, the respective constant current circuits I1 to In of the anode line drive circuit 2 can be controlled to have a definite voltage drop value that permits the constant current circuits I1 to In to guarantee the constant current drive by appropriately selecting the voltage dividing ratio of the resistors R7 and R8. With this arrangement, the power loss in the respective constant current circuits I1 to In can be reduced as much as possible.

In the above arrangement, a first control aspect of the operation of the sampling/holding circuit 8 executed by the above sampling timing control circuit 9 will be described. That is, in the first control aspect, the sampling/holding circuit 8 is operated to select an ordinary sampling hold intervals and sampling hold intervals executed at timing shorter than that of the ordinary sampling hold intervals.

In the first control aspect, the sampling timing control circuit 9 monitors the light emission state of the display panel 1 controlled by the light emission control circuit 4. In other words, the light emission control circuit 4 supplies an instruction signal to the sampling timing control circuit 9 when, for example, the light emission luminance of the light-emitting display panel is changed or when the light-emitting display panel starts to be lit. With this operation, the sampling timing control circuit 9 controls the sampling/holding circuit 8 so that it executes a sampling hold operation at shorter intervals for a predetermined period.

That is, ordinarily, the sampling timing control circuit 9 instructs the sampling/holding circuit 8 to execute the sampling hold operation at timing of, for example, several hundreds of milliseconds, thereby the sampling/holding circuit 8 holds the forward direction voltages VF of the EL elements. Then, the DC-DC converter acting as the drive voltage source 6 controls the value of the output voltage VH based on the forward direction voltages VF of the EL elements.

In contrast, when the light emission luminance of the light-emitting display panel is changed or when the light-emitting display panel starts to be lit as described above, the sampling timing control circuit 9 instructs the sampling/holding circuit 8 to execute the sampling hold at timing of, for example, several tens of milliseconds for a predetermined period.

FIG. 2 shows an example of control executed when the light emission luminance of the display panel is dropped. That is, when the display panel is ordinarily driven, the sampling/holding circuit 8 executes the sampling hold at sampling intervals (several hundreds of milliseconds) shown by c. Then, when the light emission luminance of the display panel is dropped (changed), the sampling/holding circuit 8 executes the sampling hold at sampling intervals (several tens of milliseconds) shown by c' for a predetermined period.

With this operation, the sampling/holding circuit 8 holds the forward direction voltages VF of the EL elements, and the DC-DC converter acting as the drive voltage source 6 controls the value of the output voltage VH based on the forward direction voltages VF of the EL elements. Since the output voltage VH is controlled at the sampling intervals shown by c' in this case, the luminance of the light-emitting elements drops stepwise as shown in FIG. 2. However, this drop of luminance is almost instantly executed as compared with the example shown in FIG. 10. Accordingly, a user does not visually have a feeling that the light emission luminance gently changes stepwise.

Note that while the characteristics shown in FIG. 2 show an example of control that is executed when the light emission luminance of the display panel is dropped, the light emission luminance also can be risen almost instantly when the light emission luminance is risen. Further, when the display device starts to be lit, the value of the output voltage VH can be promptly risen similarly by controlling the value of the output voltage VH at the sampling intervals shown by c'. Thus, the user visually has a feeling as if the light emission luminance of the display device rises instantly.

Further, in the above operation, when the light emission luminance of the display panel is changed while it is being lit, the voltage output from the drive voltage source based on the forward direction voltages is controlled at shorter timing. However, when, for example, the light emission luminance of the light-emitting display panel is changed beyond a predetermined range set beforehand, the voltage output from the drive voltage source may be controlled at shorter timing.

That is, when the degree of change of the light emission luminance of the light-emitting display panel is within the predetermined range set beforehand, the change of luminance is not so outstanding. In this case, even if the sampling intervals of the sampling/holding circuit 8 are relatively long as shown by c, the user does not have an impression that the luminance is changed gently.

According to the first control aspect, when the light emission luminance of the light-emitting display panel is changed or when the light-emitting display panel starts to be lit, the intervals, at which the forward direction voltages of the EL elements are subjected to the sampling hold, are set shorter than those in the ordinary operation. As a result, the degree of electric power loss caused by the sampling hold operation can be reduced.

Next, a second control aspect of the operation of the sampling/holding circuit 8 controlled by the above sampling timing control circuit 9 will be described. That is, in the second control aspect, the voltage output from the drive voltage source based on the forward direction voltages of the elements is controlled only when the light emission luminance of the light-emitting display panel is changed or only when the light-emitting display panel starts to be lit.

First, an operation executed when the light emission luminance of the light-emitting display panel is changed will be described. In this case, on receiving information indicating that the light emission luminance of the light-emitting display panel is changed from the light emission control circuit 4, the sampling timing control circuit 9 sends an instruction signal to the sampling/holding circuit 8, thereby the sampling/holding circuit 8 repeatedly executes the sampling operation at the short intervals c' of several tens of milliseconds described above for a predetermined period.

With this operation, when the light emission luminance of the light-emitting display panel is dropped as shown in FIG. 3, the forward direction voltages of the elements are repeatedly sampled at the short intervals c', thereby the user visually has a feeling that the light emission luminance of the display panel drops instantly. Further, the operation is executed similarly when the light emission luminance of the light-emitting display panel is risen, thereby the user visually has a feeling that the light emission luminance of the display panel rises instantly.

Further, when the display device starts to be lit, the value of the output voltage VH is controlled at the sampling intervals shown by c', thereby the value of the output voltage VH can be risen promptly. Thus, the user visually has a feeling as if the light emission luminance of the display device rises instantly.

The operation for sampling and holding the forward direction voltages of the elements is executed only when the light-emitting display panel starts to be lit or only when the light emission luminance of the light-emitting display panel is changed also in this case, a disadvantage that the electric power loss is caused by the sampling hold operation at all times can be avoided.

Further, in the second control aspect, it is effective that the voltage output from the drive voltage source based on the forward direction voltages of the elements be controlled once only when the light emission luminance of the light-emitting display panel is changed or only when the light-emitting display panel starts to be lit. When the above control is executed, the sampling operation is executed in a predetermined period of time (for example, in several seconds) after the light emission luminance of the light-emitting display panel has been changed or after the light-emitting display panel has started to be lit.

When the above control is executed, the intervals at which the voltage output from the drive voltage source are controlled are increased. However, the electric deterioration with age and temperature dependency of the light-emitting elements can be sufficiently compensated in practical use by the sampling operation at the time.

Note that, in the above explanation, the forward direction voltages of the respective EL elements whose lighting is controlled by the constant current circuits I1 to In provided with the anode line drive circuit 2 are sampled and held as a means for obtaining the forward direction voltages VF of the EL elements as shown in FIG. 1. However, an arrangement shown in FIG. 4 may be preferably used as the means for obtaining the forward direction voltages VF of the EL elements.

That is, in the arrangement shown in FIG. 4, a dummy organic EL element Ex that does not contribute to light emission is formed as a film on the display panel 1 together with organic EL elements for display, and a constant current is supplied to the dummy organic EL element Ex through a constant current circuit 21 driven by the output voltage VH. Then, the anode terminal of the dummy organic EL element Ex is connected to the inverted input terminal of an operational amplifier 22 and the cathode terminal thereof is grounded as well as connected to the non-inverted input terminal of the operational amplifier 22.

The operational amplifier 22 constitutes a negative feedback amplifier having a feedback resistor R9 connected between the output terminal of the operational amplifier 22 and the inverted input terminal thereof, and the output from the operational amplifier 22 is supplied to the sampling/holding circuit 8 shown in FIG. 1. According to this arrangement, the forward direction voltages VF of the EL elements can be obtained at all times making use of the dummy organic EL element Ex, thereby the switches Sh1 to Shn, and the like as shown in FIG. 1 can be omitted.

Note that when this arrangement is employed, the dummy organic EL element Ex is also lit. Thus, it is preferable to provide a masking for concealing the lit state of the dummy organic EL element Ex as necessary.

Further, while the above description has been made as to the passive matrix drive system as an example, the present invention is by no means limited to the passive matrix drive system and also can be applied to an active matrix drive system.

As apparent from the above explanation, according to the display device making use of the drive method of the present invention, in a case in which, for example, the light emission luminance of the light-emitting display panel is changed or in other case, since the output voltage from the drive voltage source is controlled at timing having intervals shorter than those in an ordinary state, the gentle changing characteristics of the light emission luminance of the display device can be improved.

What is claimed is:

1. A drive method of a light-emitting display panel including light-emitting elements whose lighting is respectively controlled through constant current circuits, in which said constant current circuits supply constant currents to said light-emitting elements, making use of a voltage output from a drive voltage source; and the voltage output from said drive voltage source is controlled based on forward direction voltages of the light-emitting elements, wherein when controlling the voltage output from said drive voltage source, said forward direction voltages are sampled at the timing at which constant currents are supplied from said constant current circuits to the light-emitting elements, so as to obtain said forward direction voltages by a sampling/hold circuit for holding the sampled voltage values, and sampling/hold operation by means of said sampling/hold circuit is carried out such that intervals of the sampling/hold are shorter than said intervals in an ordinary operation being a period except when said light-emitting display panel starts to be lit or when light emission luminance of said light-emitting display panel is changed according to a lighting drive condition of said light-emitting elements.

2. A drive method of a light-emitting display panel according to claim 1, wherein when the light-emitting display panel starts to be lit, said sampling/hold operation is carried out such that said intervals of the sampling/hold are shorter than said intervals in the ordinary operation being a period except when said light-emitting display panel starts to be lit or when light emission luminance of said light-emitting display panel is changed.

3. A drive method of a light-emitting display panel according to claim 1, wherein when the light emission luminance of the light-emitting display panel is changed, said sampling/hold operation is carried out such that said intervals of the sampling/hold are shorter than said intervals in the ordinary operation being a period except when said light-emitting display panel starts to be lit or when light emission luminance of said light-emitting display panel is changed.

4. A drive method of a light-emitting display panel according to claim 1, wherein when the light emission luminance of the light-emitting display panel is changed beyond a predetermined range set beforehand, said sampling/hold operation is carried out such that said intervals of the sampling/hold are shorter than said intervals in the ordinary operation being a period except when said light-emitting display panel starts to be lit or when light emission luminance of said light-emitting display panel is changed.

5. A drive method of a light-emitting display panel including light-emitting elements whose lighting is respectively controlled through constant current circuits, in which the constant current circuits supply constant currents to the light-emitting elements, making use of a voltage output from a drive voltage source; and the voltage output from said drive voltage source is controlled based on forward direction voltages of the light-emitting elements, wherein when controlling the voltage output from said drive voltage source, said forward direction voltages are sampled at the timing at which constant currents are supplied from said constant current circuits to the light-emitting elements, so as to obtain said forward direction voltages by a sampling/hold circuit for holding the sampled voltage values, and sampling/hold operation by means of said sampling/hold circuit is carried out such that intervals of the sampling/hold in an ordinary operation being a period except when said light-emitting display panel starts to be lit or when light emission luminance of said light-emitting display panel is changed and sampling hold intervals executed at timing shorter than those in the ordinary operation are selected based on a lighting drive condition of said light-emitting elements.

6. A drive method of a light-emitting display panel according to claim 5, wherein when said light-emitting display panel starts to be lit, the intervals of the sampling/hold executed at the timing shorter than the intervals of sampling/hold in the ordinary operation being a period except when said light-emitting display panel starts to be lit or when light emission luminance of said light-emitting display panel is changed are selected.

7. A drive method of a light-emitting display panel according to claim 5, wherein when the light emission luminance of the light-emitting display panels is changed, the intervals of the sampling/hold executed at the timing shorter than the intervals of sampling/hold in the ordinary operation being a period except when said light-emitting display panel starts to be lit or when light emission luminance of said light-emitting display panel is changed are selected.

8. A drive method of a light-emitting display panel according to claim 5, wherein when the light emission luminance of the light-emitting display panels is changed beyond a predetermined range set beforehand, the intervals of the sampling/hold executed at the timing shorter than the intervals of sampling/hold in the ordinary operation being a period except when said light-emitting display panel starts to be lit or when light emission luminance of said light-emitting display panel is changed are selected.

9. A drive method of a light-emitting display panel according to claim 1 or 5, wherein the voltage output from the drive voltage source based on the forward direction voltages is controlled when the light-emitting display panel starts to be lit or when the light emission luminance of the light-emitting display panel is changed.

10. A drive method of a light-emitting display panel according to claim 9 wherein the voltage output from the drive voltage source based on the forward direction voltages is repeatedly controlled a plurality of times when the light-emitting display panel starts to be lit or when the light emission luminance of the light-emitting display panel is changed.

11. A drive method of a light-emitting display panel according to any one of claims 1 to 8, wherein the forward direction voltages are obtained by adding a constant current to a dummy light-emitting element that does not contribute to the light emission of the light-emitting display panel.

12. A drive method of a light-emitting display panel according to claim 9 wherein the forward direction voltages are obtained by adding a constant current to a dummy light-emitting element that does not contribute to the light emission of the light-emitting display panel.

13. A drive method of a light-emitting display panel according to claim 10, wherein the forward direction voltages are obtained by adding a constant current to a dummy light-emitting element that does not contribute to the light emission of the light-emitting display panel.

14. A drive method of a light-emitting display panel according to any one of claims 1 to 8, wherein a voltage drop in the constant current circuits is controlling the voltage output from the drive voltage source.

15. A drive method of a light-emitting display panel according to claim 9, wherein a voltage drop in the constant current circuits is controlling the voltage output from the drive voltage source.

16. A drive method of a light-emitting display panel according to claim 10, wherein a voltage drop in the constant current circuits controlling the voltage output from the drive voltage source.

17. A drive method of a light-emitting display panel according to any one of claims 1 to 8, wherein a voltage increasing type DC-DC converter is used as the drive voltage source.

18. A drive method of a light-emitting display panel according to claim 9, wherein a voltage increasing type DC-DC converter is used as the drive voltage source.

19. A drive method of a light-emitting display panel according to claim 10, wherein a voltage increasing type DC-DC converter is used as the drive voltage source.

20. An organic EL display device, wherein the light-emitting elements are composed of organic EL elements driven and lit by a drive method according to any of claims 1 to 8.

21. An organic EL display device, wherein the light-emitting elements are composed of organic EL elements driven and lit by a drive method according to claim 9.

22. An organic EL display device, wherein the light-emitting elements are composed of organic EL elements driven and lit by a drive method according to claim 10.

23. An organic EL display device, wherein the light-emitting elements are composed of organic EL elements driven and lit by a drive method according to claim 11.

* * * * *